US008607423B2

(12) United States Patent
Davis et al.

(10) Patent No.: US 8,607,423 B2
(45) Date of Patent: Dec. 17, 2013

(54) CASKET INSERT ROLLER SYSTEM

(75) Inventors: Gerald H. Davis, Fountain City, IN (US); Chad L. Eversole, Richmond, IN (US); Gary L. Cox, Richmond, IN (US)

(73) Assignee: Vandor Corporation, Richmond, IN (US)

( * ) Notice: Subject to any disclaimer, the term of this patent is extended or adjusted under 35 U.S.C. 154(b) by 29 days.

(21) Appl. No.: 13/334,685

(22) Filed: Dec. 22, 2011

(65) Prior Publication Data

US 2013/0160258 A1 Jun. 27, 2013

(51) Int. Cl.
*A61G 17/00* (2006.01)

(52) U.S. Cl.
USPC ..... 27/35; 27/12; 27/19; 27/27

(58) Field of Classification Search
USPC ..... 27/2, 12, 27, 35, 19; 414/529; 211/85.16; 220/23.87, 23.89; 52/128, 52/133
See application file for complete search history.

(56) References Cited

U.S. PATENT DOCUMENTS

| | | | | |
|---|---|---|---|---|
| 114,315 | A * | 5/1871 | Margerum | 27/11 |
| 1,799,586 | A * | 4/1931 | Foster | 27/35 |
| 1,928,217 | A * | 9/1933 | Bruning | 27/26 |
| 2,735,157 | A * | 2/1956 | Hotchkiss et al. | 27/12 |
| 3,133,334 | A * | 5/1964 | Johnsen | 27/27 |
| 3,613,189 | A * | 10/1971 | Kirby | 27/35 |
| 3,654,676 | A * | 4/1972 | McHugh | 27/2 |
| 3,810,282 | A * | 5/1974 | Doggett | 27/35 |
| 4,788,757 | A * | 12/1988 | Bethune et al. | 27/2 |
| 5,956,825 | A * | 9/1999 | McCoy et al. | 27/2 |
| 6,324,737 | B1 * | 12/2001 | Chamness et al. | 27/2 |
| 7,302,743 | B2 * | 12/2007 | Fash | 27/4 |
| 7,350,278 | B2 * | 4/2008 | Davis et al. | 27/35 |
| 7,882,606 | B2 * | 2/2011 | Elhaj | 27/27 |
| 7,904,999 | B2 * | 3/2011 | Steinhaus | 27/12 |
| 8,127,414 | B2 * | 3/2012 | Rankin | 27/35 |

FOREIGN PATENT DOCUMENTS

GB 2334946 A * 9/1999

* cited by examiner

*Primary Examiner* — William Miller
(74) *Attorney, Agent, or Firm* — Maginot, Moore & Beck

(57) ABSTRACT

A casket system includes a casket container and a movable platform. The casket container has a bottom, and includes a plurality of rollers supported by said bottom. The movable platform is disposed within the casket container. The movable platform including slots extending through the platform and aligned horizontally with the plurality of rollers, the movable platform having a raised position and a lowered position, wherein at least a portion of a first number of the plurality of rollers extend through the slots and stand proud the movable platform in the lowered position, and a portion of fewer than the first number of the plurality of rulers stand proud the movable platform in the raised position.

17 Claims, 9 Drawing Sheets

CASKET INSERT ROLLER SYSTEM

FIELD OF THE INVENTION

This application relates to the field of caskets and particularly to casket inserts used within rental caskets.

BACKGROUND

Burial or cremation containers, referred to herein collectively as caskets, are one of the most expensive elements of a traditional funeral. Costs associated with traditional caskets are attributable in significant part to the material and labor cost of forming a traditional casket of wood or metal material. Accordingly, one way to reduce casket (and hence funeral) costs includes the use of caskets made from alternative materials, such as paperboard. Such caskets are particularly suitable for cremation. However, caskets constructed of alternative materials of paperboard often do not provide as pleasing a presentation of the deceased during the wake or viewing. While advances in the construction of paperboard caskets have resulted in aesthetic improvements, such caskets still lack the aesthetic appeal of traditional wood caskets.

One solution to the countervailing tensions of reducing cost and retaining aesthetic appeal of wood (or metal) caskets involves the use of a reusable rental casket. Specifically, if a casket is desired for a traditional ceremony or viewing but not needed for burial because cremation has been elected, a paperboard casket or body tray may be inserted into a more ornate rental casket to provide an aesthetic viewing experience.

One of the issues of known rental systems is the method by which the paperboard insert or tray is placed within and removed from the reusable casket. In one known rental casket system, a foot panel opens at one end to facilitate insertion and removal of the insert into and out of the rental casket. In such a system, the paperboard tray or casket insert may also serve as part or all of the cremation container. The insertion and removal of the casket insert, however, may be difficult due to friction between the bottom of the casket insert and the bottom of the rental casket.

There is a need, therefore, for a casket system that addresses the needs for reduced cost and aesthetically pleasing presentation without inherent difficulties associated with known rental casket systems.

SUMMARY OF THE INVENTION

At least some of the embodiments of the present invention address the above-described need by providing a casket system employing a system of roller assemblies and movable platform that can be used to facilitate insertion and removal of a casket insert into the casket container. The casket container may suitably be an aesthetically pleasing structure that can be reused with multiple casket inserts.

A first embodiment is a casket system that includes a casket container and a movable platform. The casket container has a bottom, and includes a plurality of rollers supported by said bottom. The movable platform is disposed within the casket container. The movable platform including slots extending through the platform and aligned horizontally with the plurality of rollers, the movable platform having a raised position and a lowered position, wherein at least a portion of a first number of the plurality of rollers extend through the slots and stand proud the movable platform in the lowered position, and a portion of fewer than the first number of the plurality of rulers stand proud the movable platform in the raised position.

The above-described features and advantages, as well as others, will become more readily apparent to those of ordinary skill in the art by reference to the following detailed description and accompanying drawings.

DETAILED DESCRIPTION

Figure 1A:
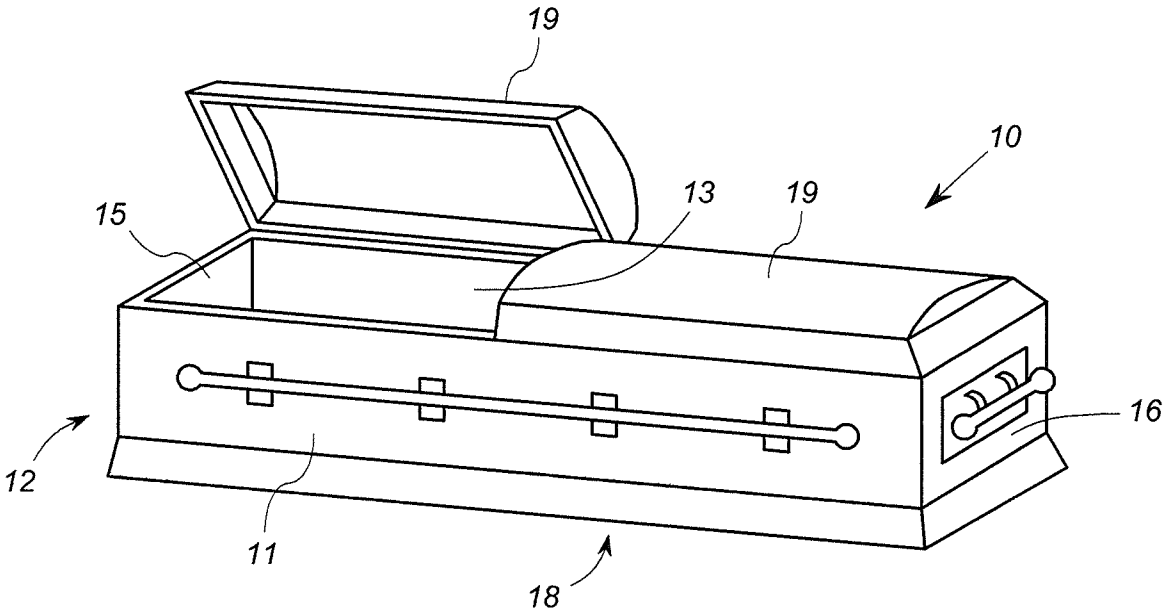
FIG. 1A depicts a perspective view of a casket container of a reusable casket system according to a first embodiment of the invention.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one of ordinary skill in the art to which this invention pertains.

Figure 1B:
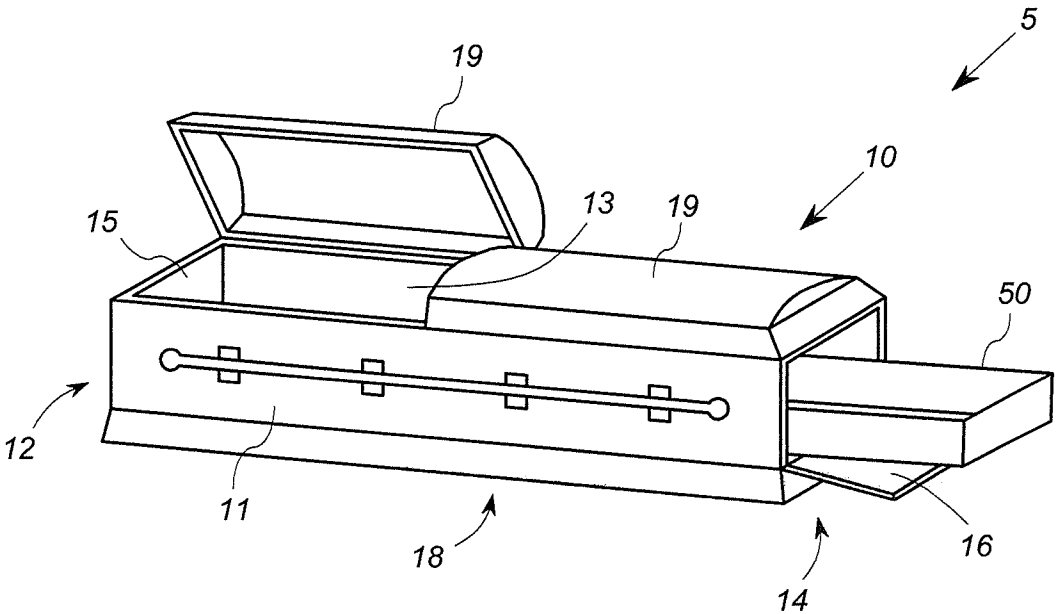
FIG. 1B depicts a perspective view of the casket container of FIG. 1A and a casket insert of the reusable casket system according to the first embodiment of the invention.

FIGS. 1A and 1B show a casket system 5 that includes a casket container 10 and a casket insert 50 (see FIG. 1B). In general, the casket container 10 may suitably be a substantial structurally and aesthetically pleasing for viewing a deceased. By way of example, the casket container 10 may be constructed of hardwood, or laminated wood. The casket insert 50 is an open container that may be used as transport and support mechanism for the deceased. The casket insert 50 is configured to slide into and out of the casket container 10 at a first end thereof. FIG. 1B shows the casket insert 50 partially inserted into the casket container 10.

Referring to FIGS. 1A and 1B, the casket container 10 include side panels 11, 13, a head panel 15 and a foot panel 16 arranged in an elongate box that includes a head portion 12 and a foot portion 14. The foot portion 14 is the portion of the casket container proximate the foot panel 16. As is known in the art, the foot panel 16 is pivotally attached to can pivot between an open position to receive the insert 50 (shown in FIG. 1B) and a closed position (shown in FIG. 1A) to retain the insert 50. In an alternative embodiment, the foot panel 16 can be completely removable, or a portion thereof complete removable or pivotally attached. In any event, the casket container 10 also includes a bottom 18, and a conventional lid 19.

Figure 2:
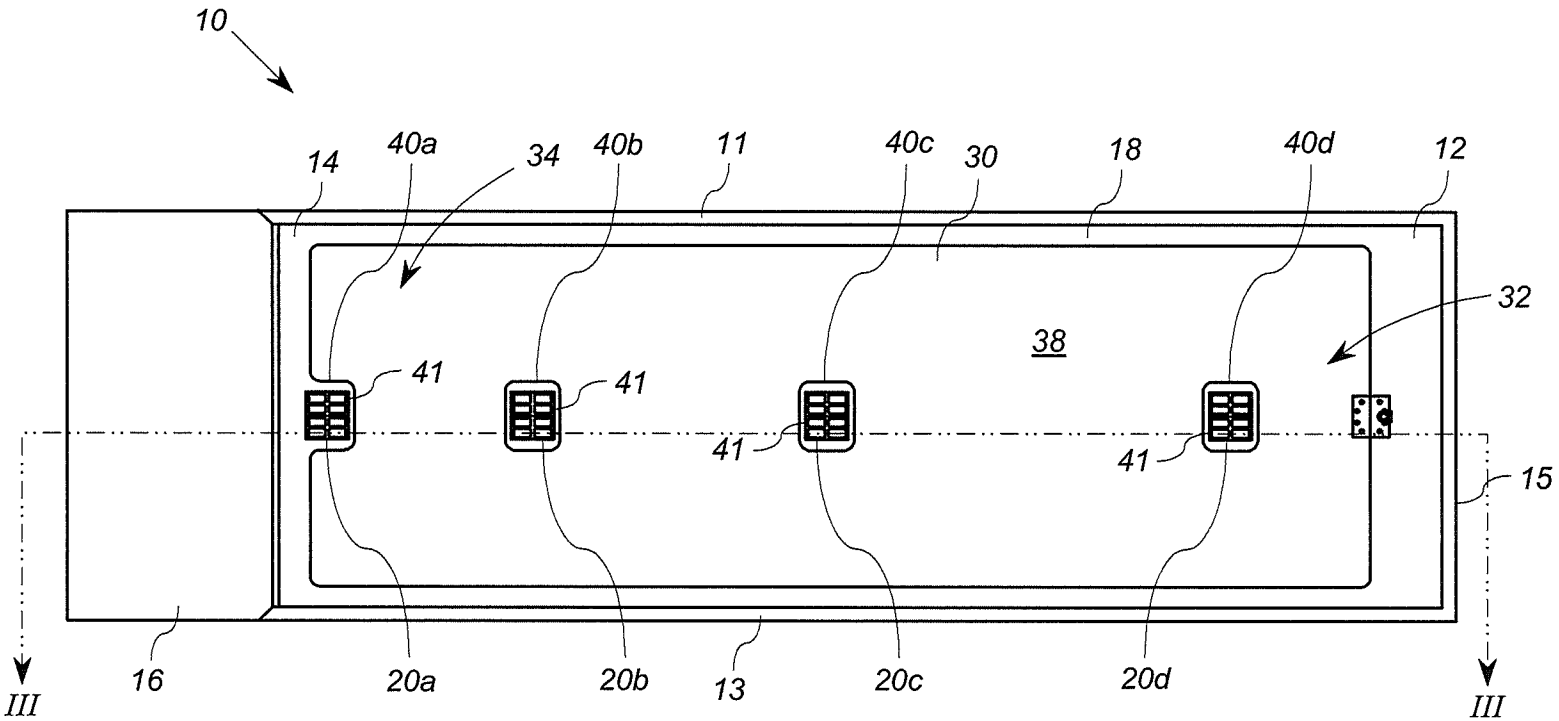
FIG. 2 depicts a top view of the casket container of FIG. 1A.

FIG. 2 shows a top plan view of the casket container 10 with the foot panel 16 in the open position, and with the lid 19 removed for purposes of clarity. As shown in FIG. 2, the casket container 10 includes four roller assemblies 20*a*-20*d* and a movable or adjustable bed platform 30. Each of the roller assemblies 20*a*-20*d* is configured to be mounted or secured to the bottom 18 either directly or indirectly, and to expose rolling surfaces 41 of rotatable rollers of the roller assemblies. Further details regarding an exemplary roller assembly 20 is provided below in connection with FIGS. 7A and 7B.

Referring again to FIG. 2, the four roller assemblies 20*a*-20*d* are spaced along the bottom 18 from the foot portion 14 to the head portion 12. The roller assemblies 20*a*-20*d* are not evenly spaced but are closer together at the foot portion 14 than the head portion 12 of the casket container 10. For example, the first roller assembly 20*a* may be two to three inches from the foot panel 16, the second roller assembly 20*b* may be 12 to 13 inches from the first roller assembly 20*a*, the third roller assembly 20*c* may be 18 to 19 inches from the second roller assembly 20*b* and the fourth roller assembly 20*d* may be 25 to 26 inches from the third roller assembly 20*c*.

The movable bed platform 30 is sized and configured to fit inside the assembled side and end panels 11, 13, 15 and 16 of the casket container 10. The movable bed platform 30 includes four slots 40*a*-40*d* extending therethrough, and which are sized and configured to align with the four roller assemblies 20*a*-20*d*.

Figure 3:
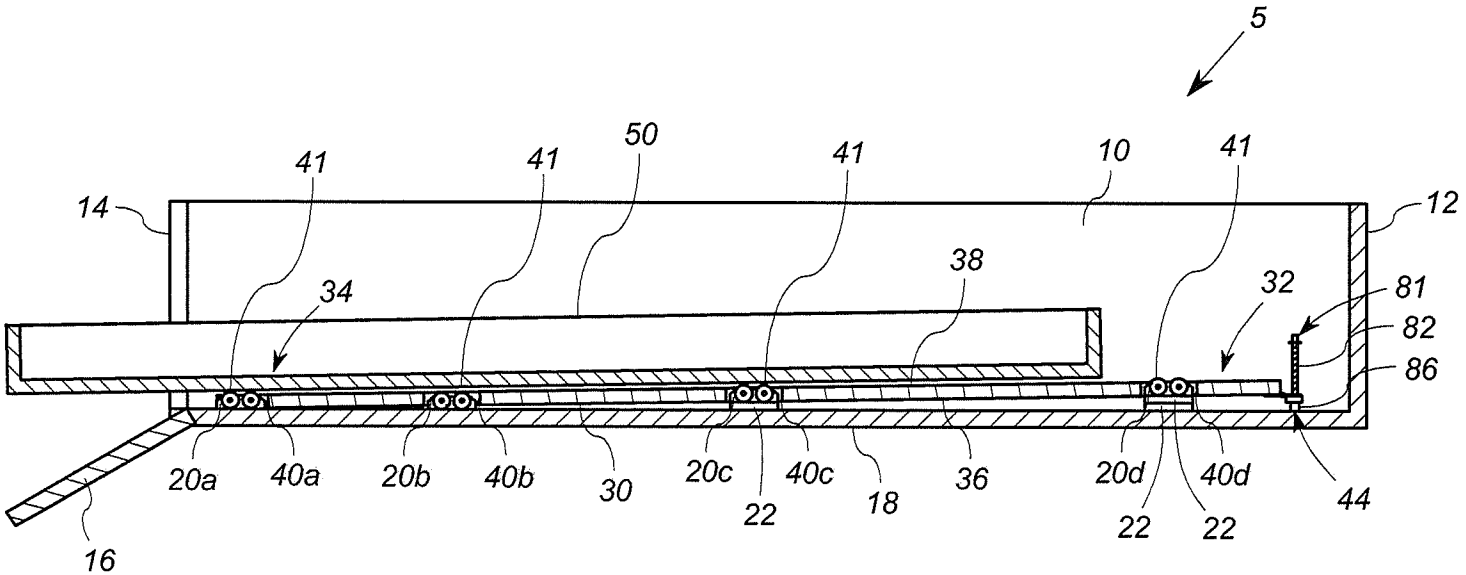
FIG. 3 depicts a cutaway side view of a casket system according to the first embodiment of the invention wherein the casket insert is partially inserted into the casket container.
Figure 4:
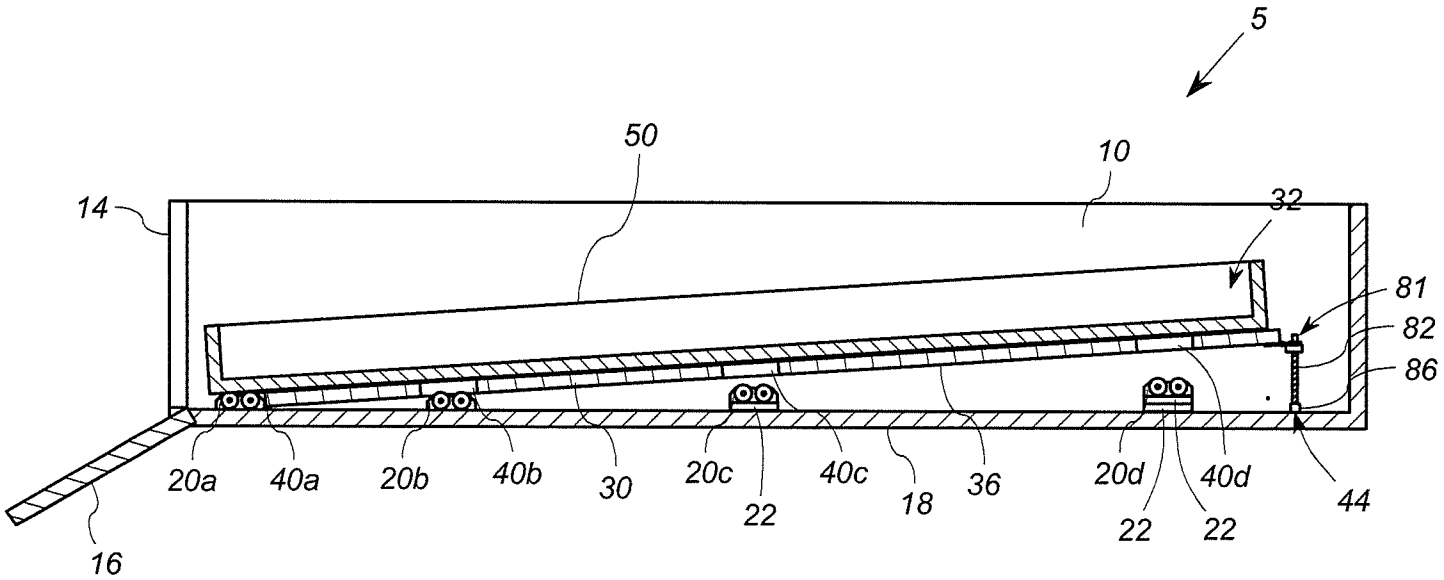
FIG. 4 depicts a cutaway side view of a casket system of FIG. 3 wherein the casket insert is fully inserted into the casket container and raised for viewing.

FIGS. 3 and 4 show cutaway side views of the casket arrangement 5, without the lid 19, taken along line III-III of FIG. 2. In contrast to FIG. 2, however, FIGS. 3 and 4 also show the casket insert 50 disposed at least partly within the casket container 10. As shown in FIGS. 3 and 4, the roller assemblies 20*a*-20*d* extend upwardly from the bottom 18 of the casket container 10. The third roller assembly 20*c* is supported by a block 22 and the fourth roller assembly 20*d* is supported by two blocks 22. Thus, the height of the roller assemblies 20*a*-20*d* increases monotonically from the foot portion 14 to the head portion 12. For example, the first and second roller assemblies 20*a*, 20*b* may extend to the same height, 1.0 to 1.2 inches, from the bottom 18, the third roller assembly 20*c* may extend 1.5 to 1.7 inches from the bottom 18 and the fourth roller assembly 20*d* may extend 2.0 to 2.2 inches from the bottom 18 of the casket container 10.

As also shown in FIGS. 3 and 4, a lift mechanism 44, which in this embodiment comprises a screw mechanism, is configured to raise and lower at least a portion of the platform 30 near the head end 12 of the casket container 10. In this manner, the head end of the platform 30 may be moved from a lowered position to a raised position, as shown in FIGS. 3 and 4 respectively.

Figure 8:
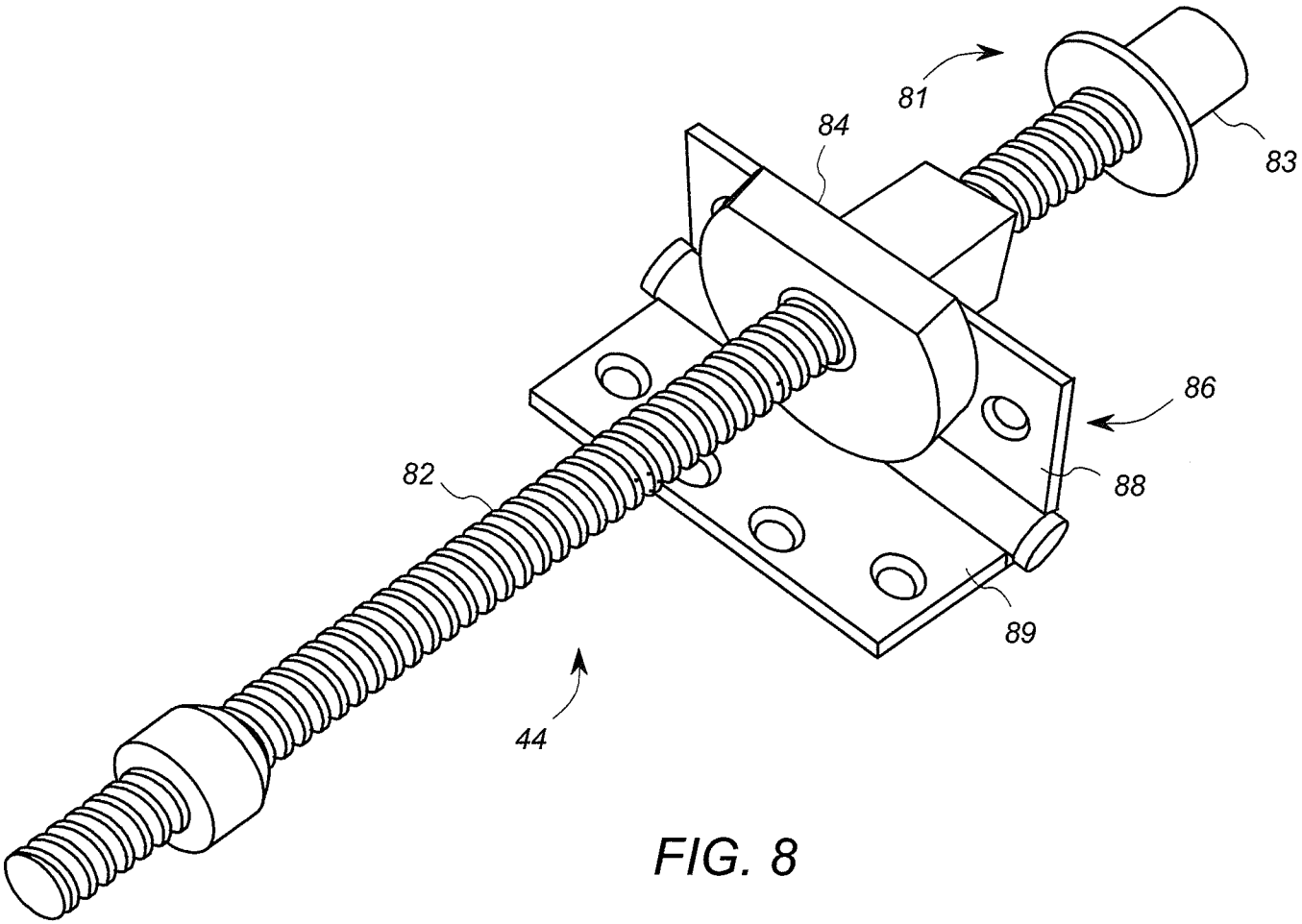
FIG. 8 depicts a perspective view of an exemplary lift mechanism of the casket system of FIG. 3.

To this end, FIG. 8 shows in further detail a perspective view of an exemplary screw lift mechanism 44 that may be used to move the movable platform 30 between the raised and lowered positions as shown in FIGS. 3 and 4. With reference to FIGS. 3, 4 and 8, the mechanism 44 includes a threaded rod 82 that rotatably engages a linear bearing/worm gear 84, as is known in the art. The linear bearing/worm gear 84 fixedly mounted to a mounting structure 86 that includes a first mounting plate 88 configured support the linear bearing/worm gear 84. The mounting structure further includes a second mounting plate 89 coupled to the first mounting plate 88. The second mounting plate 89 is configured to securedly attach to the head end 32 of the movable platform 30.

Figure 6:
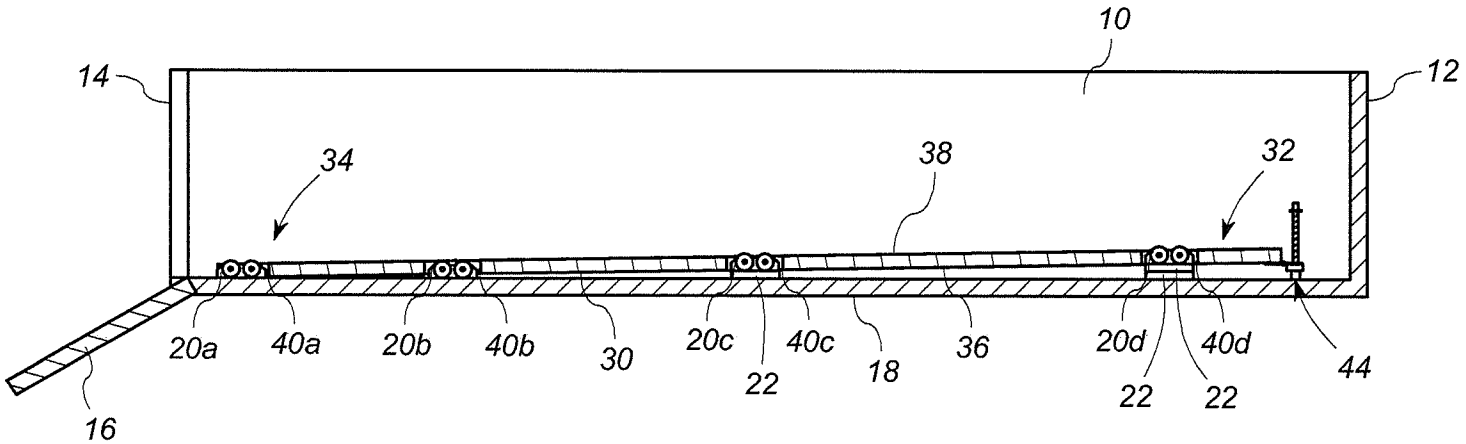
FIG. 6 depicts a cutaway side view of the casket container of the casket system of FIG. 3 apart from the casket insert.

In the embodiment described herein, the second mounting plate 89 is hingedly attached to the first mounting plate 88 to allow for angular movement between the head end 32 of the movable platform 30 and the first mounting plate 88 (and hence the threaded rod 82), reducing strain on the screw lift mechanism 44. It will be appreciated that in FIG. 8, the second mounting plate 89 is shown substantially perpendicular to the first mounting plate 88, although in practice the second mounting plate 89 will be rotated to closer to parallel with and even substantially planar with the first mounting place, as shown in FIGS. 2, 4 and 6.

At the top 81 of the threaded rod 82 is a hex key head 83 having a hex key receptacle (not shown) to facilitate the rotation of the threaded rod 82.

Referring again to FIGS. 3 and 4, FIG. 3 shows the adjustable bed platform 30 in a lowered position wherein the bed screw mechanism 44 has been rotated to lower the platform 30. In this embodiment, when the platform 30 is in the lowered position, surfaces of the rollers of the roller assemblies 20*a*-20*d* extend upwardly through the slots 40*a*-40*d* such that at least part of the roller surfaces 41 stand proud of the top surface 38 of the adjustable bed platform 30.

Accordingly, when the movable platform 30 is in the lowered position, the casket insert 50 rests on at least some, and preferably most or all, of the roller surfaces 41 of the roller assemblies 20*a*-20*d*. As a consequence, the casket insert 50 may be rolled along the roller assemblies 20*a*-20*d* as it is inserted into the casket container 10 until the head end 52 of the casket insert 50 is positioned at the head portion 12 of the casket container 10. Likewise, the casket insert 50 may be rolled along the roller assemblies 20*a*-20*d* to during removal of the insert 50 from the casket container 10.

FIG. 4, by contrast, shows the adjustable bed platform 30 is in a raised position wherein the bed screw mechanism 44 has been rotated until the second, third and fourth roller assemblies 20*b*-20*d* do not extend upwardly through the second, third and fourth slots 40*b*-40*d*. When the adjustable bed platform 30 is in the raised position, the roller surfaces 41 of the roller assemblies 20*a*-20*d* no longer stand proud of the adjustable bed platform 30. Because the adjustable bed platform 30 is coupled to the casket container 10 at the foot portion 14 of the casket container 10, the first roller assembly 20*a* may still extend slightly above the adjustable bed platform 30 even when in the raised position. Because the roller surfaces 41 of the roller assemblies 20*b*-20*d* no longer stand proud of the adjustable bed insert 30 when in the raised position, the casket insert 50, which is positioned on the adjustable bed platform 30, no longer rolls on the roller assemblies 20*a*-20*d* and the head end 52 of the casket insert 50 is raised for viewing by the head end 32 of the adjustable bed platform 30 within the casket container 10.

With general reference to FIGS. 2, 3 and 4, the adjustable bed platform 30 includes a head end 32, a foot end 34, a bottom surface 36 and a top surface 38. The adjustable bed platform 30 is dimensioned so that the adjustable bed platform 30 may fit within and rest on the bottom 18 of the assembled panels 11, 13, 15 and 16 casket container 10. The adjustable bed platform 30 includes four slots 40*a*-40*d* spaced between the head end 32 and the foot end 34. The slots 40*a*-40*d* are configured so that they align with, and receive, the roller assemblies 20*a*-20*d* when the adjustable bed platform 30 rests on the bottom 18 of the casket container 10.

The blocks 22 are sized so that they do not pass through the slots 40*a*-40*d* but the remaining portions of the roller assemblies 20*a*-20*d* may pass through the slots 40*a*-40*d*. As discussed above, when the roller assemblies 20*a*-20*d* pass through the slots 40*a*-40*d*, the rotating surfaces of the rollers thereof stand proud of the adjustable bed platform 30.

As discussed above, the casket container 10 also includes a bed screw mechanism 44 attached to the movable bed platform 30 near the headend 32 thereof. The bed screw mechanism 44 extends downwardly from the bottom surface 36 of the adjustable bed platform 30 and contacts the bottom 18 of the casket container 10. The bed screw mechanism 44 is well known in the art and is used to raise and lower the head end 32 of the adjustable bed platform 30. Other suitable casket lift mechanisms capable of raising and lowering the head end of the platform 30 would be known to those of ordinary skill in the art.

Referring back generally to FIGS. 2, 3 and 4, during normal use, the head end 32 is raised while the deceased is in the casket container 10 to improve the visibility of the deceased during a funeral or other ceremony and is lowered for transportation or interment.

Figure 5:
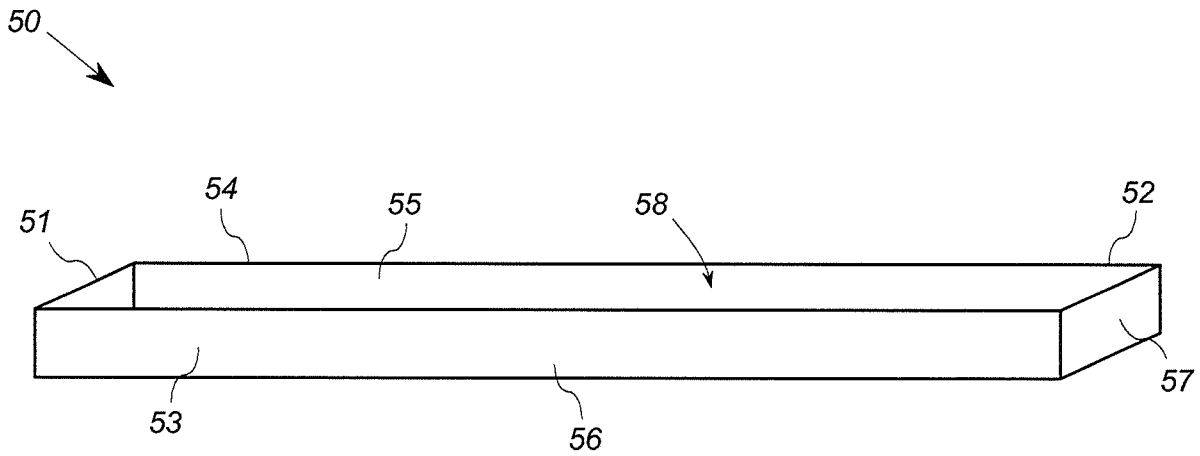
FIG. 5 depicts a perspective view of a casket insert of the casket system of FIG. 3 apart from the casket container.

Referring to FIG. 5, a perspective view of the casket insert 50 is shown. The casket insert 50 is dimensioned and configured to carry the deceased and to slide through an opening between the side panels 11, 13, formed by the removal/opening of the foot panel 16. The casket insert 50 is configured to rest on the adjustable bed platform 30 within the casket container 10, as shown in FIGS. 3 and 4. The casket insert 50 includes four side panels 51, 53, 55 and 57 and a bottom panel 56 defining a rectangular container having an interior 58 for receiving a deceased. The casket insert 50 includes a head end 52 and a foot end 54 and may be made of a paperboard or any other material, preferably flammable which is sturdy enough to support the weight of the deceased. The walls 51, 53, 55 and 57 preferably have a height that, when disposed on the movable platform 30 in the raised position, is less than or equal to the height of panels 11, 13 of the container 10. Accordingly, even when the platform 30 is in the raised position, visibility of the walls 51, 53, 55 and 57 is substantially inhibited, at least from a side view. It will be appreciated that in this context, the "raised position" means any position in which fewer than all (and possibly none) of the roller assemblies 20*a*-20*b* engage the insert 50.

In use, the casket container 10 is empty when it is ready for accepting a casket insert 50 with a deceased. The casket container 10 in this condition may suitably appear as shown in FIG. 1A. To start the process of placing the casket insert 50 into the casket container 10, the foot panel 16 is "opened" by pivoting the foot panel 16 downward, as shown in FIG. 6. The adjustable bed platform 30 should be, or at least be placed, in the lowered position as shown in FIG. 6.

After the casket container 10 is configured as shown in FIG. 6, the casket insert 50, bearing the deceased, is inserted through the opening in the foot portion 14 where the foot panel 16 had been before it was pivoted downward. FIGS. 1A and 3 show the casket insert 50 partially inserted into the casket container 10. During the insertion, the rolling surfaces 41 of the roller assemblies 20*a*-20*d* engage the bottom panel 56 of the casket insert 50 and assist the insertion of the casket insert 50 into the casket container 10. Once the casket insert 50 is fully inserted into the casket container 10, the foot panel 16 is pivoted to the closed position.

The bed screw mechanism 44 is rotated in a manner that raises the adjustable bed platform 30 from the lowered position and thus moves the second, third and fourth roller assemblies 20*b*-20*d* from the corresponding slots 40*b*-40*d* such that the roller surfaces 41 thereof no longer contact the bottom surface 56 of the casket insert 50.

In further detail, to move the movable platform 30 between the lowered and raised positions (FIGS. 3 and 4), an operator inserts a hex key, not shown, but well known in the art, into the hex key receptacle of the hex key head 83. The operator then rotates the key, which rotates the threaded rod 82. As the threaded rod 82 rotates, the linear bear/worm gear 84 moves up or down, depending on the direction of rotation. The head portion 32 of the movable platform 30 moves with the linear bearing/worm gear 84 because it is fixedly attached thereto.

When the adjustable bed platform 30 is in the raised position (shown in FIG. 4), the head end 52 of the casket insert 50 is raised relative to the casket container 10. Once the viewing is complete, the bed screw mechanism 44 is rotated such that the adjustable bed platform 30 is returned to the lowered position (shown in FIG. 3). The foot panel 16 is pivoted to the open position and the casket insert 50 is removed through the foot portion 14 of the casket container 10. The casket container 10 may then be reused with another similar casket insert in the future.

In this embodiment, the adjustable bed platform 30 is never fully horizontal, even in the lowered position because of the support provided by the blocks 22 under the third and fourth roller assemblies 20*c*, 20*d*. This angle aids in the initial phase of removing the casket insert 50 from the casket container 10. However, as the head end 52 of the casket insert 50 passes over the first and second roller assemblies 20*a*, 20*b*, which do not have any blocks 22, the foot end 54 of the casket insert 50 may be raised so that the casket insert 50 is nearly horizontal. This angle aids in the final phase of removing the casket insert 50 from the casket container 10 and transferring it to another table or platform.

In other words, the use of identical heights for the roller assemblies 20*a*, 20*b* and the monotonically increasing height of the roller assemblies 20*c*, 20*d* provide for specific advantages in placement and removal of the insert 50. When the casket insert 50 is mostly out of the container 10, it may be moved horizontally. When the casket insert 50 is mostly (or fully) within the container 10, the slight grade formed by the roller assemblies 20*c*, 20*d* can aid in removal.

Figure 7A:
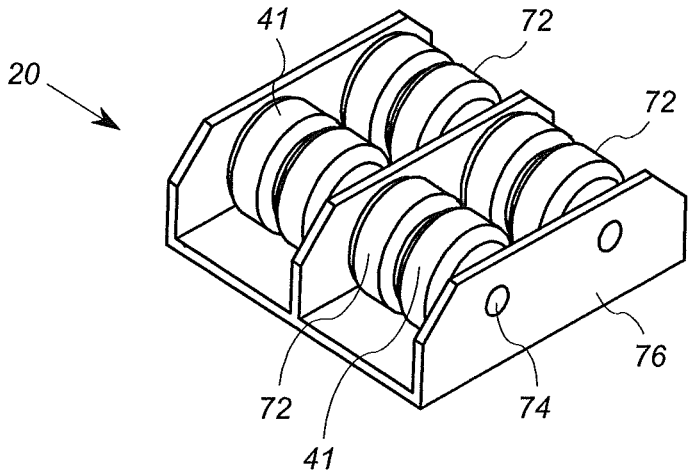
FIGS. 7A and 7B depict perspective and side plan view of an exemplary roller assembly that may be used in the casket system of FIG. 3.
Figure 7B:
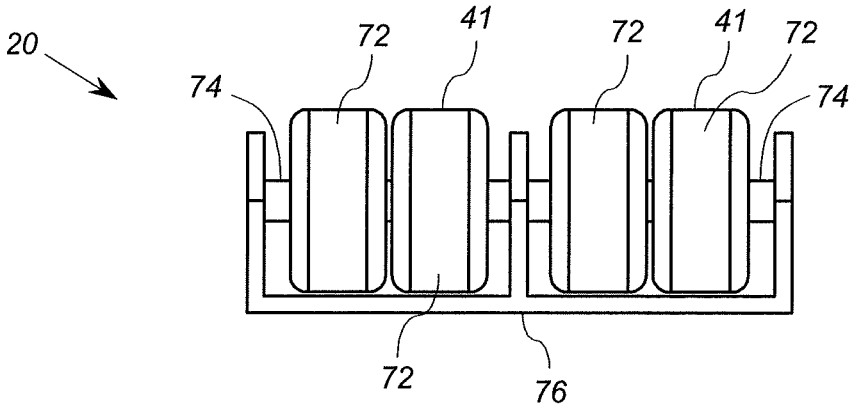

FIGS. 7A and 7B show an exemplary embodiment of a roller assembly 20 that may be used as any of the roller assemblies 20*a*-20*d*. FIG. 7A is a perspective view of the roller assembly 20, and FIG. 7B is a side plan view of the roller assembly 20. In this embodiment, the roller assembly includes eight chamfered rollers 72, each having an outer rolling surface 41. The rollers 72 are rotatably attached by four axles 74 to a double-U shaped metal frame 76. Such roller assemblies are commonly used in further moving equipment, and may be readily incorporated into an existing or new casket container. However, it will be appreciated that other roller assemblies may suitably be used.

It will be appreciated that the above describe embodiments are merely illustrative, and that those of ordinary skill in the art may readily device their own implementations and adaptations that incorporate the principles of the present invention and fall within the spirit and scope thereof.

What is claimed is:

1. A casket system comprising:

a casket container having a bottom, said casket container including a plurality of rollers supported by said bottom;

a movable platform disposed within the casket container, said movable platform including slots extending through the platform and aligned horizontally with said plurality of rollers, the movable platform having a raised position and a lowered position, wherein a portion of a first number of the plurality of rollers extend through the slots and stand proud the movable platform in the lowered position, and a portion of fewer than the first number of the plurality of rollers stand proud the movable platform in the raised position.

2. The casket system of claim 1, further comprising an insert configured to be supported by said adjustable platform, said insert configured to roll on said first number of the plurality of rollers when the movable platform is in the lowered position, and to rest on the platform when the movable platform is in the raised position.

3. The casket system of claim 1, wherein said plurality of rollers includes four roller assemblies and said movable platform includes four of said slots which are configured to align horizontally correspond with said roller assemblies.

4. The casket system of claim 3, wherein said roller assemblies are spaced unevenly along said bottom.

5. The casket system of claim 4, wherein a height of the roller assemblies monotonically increases dependent on a location of the roller assemblies between a foot end of the casket container and a head end of the casket container.

6. The casket system of claim 3, wherein said bottom of said casket container includes blocks disposed between said bottom and fewer than all of said roller assemblies.

7. The casket system of claim 6, wherein the blocks are disposed such that a height of the roller assemblies monotonically increases dependent on a location of the roller assemblies between a foot end of the casket container and a head end of the casket container.

8. The casket system of claim 1, wherein said movable platform further includes a screw mechanism coupled to said movable platform and supported by said bottom of said casket container, said screw mechanism configured to raise and lower at least a part of said movable platform relative to said casket container such that the movable platform is moved between the lowered position and raised position.

9. A casket system comprising:

a casket container having a bottom, said casket container including a plurality of rollers supported by said bottom;

a movable platform disposed within the casket container, said movable platform including slots extending through the platform and aligned horizontally with said plurality of rollers.

10. The casket system of claim 9, further comprising an insert configured to be supported by said adjustable platform, said insert configured to be inserted and removed from said casket container.

11. The casket system of claim 9, wherein said plurality of rollers includes four roller assemblies and said movable platform includes four of said slots which are configured to align horizontally correspond with said roller assemblies.

12. The casket system of claim 11, wherein said roller assemblies are spaced unevenly along said bottom and said slots which correspond with said roller assemblies are spaced unevenly along said movable platform correspondingly.

13. The casket system of claim 9, wherein said movable platform further includes a screw mechanism coupled to a bottom surface of said movable platform and to said bottom of said casket container, said screw mechanism configured to raise and lower at least a part of said movable platform relative to said casket container.

14. The casket system of claim 13, wherein a first number of said rollers contact said insert when said movable platform is in a lowered position.

15. The casket system of claim 14, wherein fewer than the first number of said rollers contact said insert when said movable platform is in a raised position.

16. The casket system of claim 14, wherein said bottom of said casket includes blocks disposed between said bottom and fewer than all of said rollers.

17. The casket system of claim 16, wherein the blocks are disposed such that a height of the rollers monotonically increases dependent on the location of the rollers between a foot end of the casket container and a head end of the casket container.

* * * * *